US005390823A

United States Patent [19]

Kilgore

[11] Patent Number: 5,390,823

[45] Date of Patent: Feb. 21, 1995

[54] OIL FILTER HAND PUNCH AND DRAIN TOOL

[76] Inventor: Gary H. Kilgore, 206 Laurel Heights Pl., San Antonio, Tex. 78212

[21] Appl. No.: 183,363

[22] Filed: Jan. 19, 1994

[51] Int. Cl.[6] ..... B67D 5/00

[52] U.S. Cl. ..... 222/81; 222/192; 30/124; 137/318

[58] Field of Search ..... 222/81, 192; 7/100, 7/138, 142, 158, 170; 137/318; 30/366, 124, 141; 184/1.5

[56] References Cited

U.S. PATENT DOCUMENTS

| | | | |
|---|---|---|---|
| 398,162 | 2/1889 | Keane | 222/81 |
| 4,177,529 | 12/1979 | Sikula et al. | 7/100 |
| 4,600,125 | 7/1986 | Maynard, Jr. | 222/81 |
| 4,739,861 | 4/1988 | Desjardins | 184/1.5 |
| 4,951,721 | 8/1990 | Moore et al. | 7/142 X |
| 5,121,776 | 6/1992 | Kovach | 184/1.5 X |
| 5,271,299 | 12/1993 | Wadsworth | 7/100 X |
| 5,291,914 | 3/1994 | Bares et al. | 137/318 X |
| 5,299,714 | 4/1994 | Kilgore | 222/81 |

FOREIGN PATENT DOCUMENTS

| | | | |
|---|---|---|---|
| 2136781 | 9/1984 | United Kingdom | 222/81 |

*Primary Examiner*—Gregory L. Huson

[57] ABSTRACT

An Oil Filter Punch is a hand tool for draining vehicular oil filters. The tool separates into two assemblies: a Valve and Handle segment; and a Punch and Drain Tube segment. A User may obtain Punch and Drain Tubes of different lengths. The purpose of this segmentation is to allow a User to attach the Punch and Drain Tube with the most suitable length for each filter access problem. The Punch is placed against the lowest point of an installed oil filter. Using simple arm strength or a rubber mallet, the tool is driven through the sheetmetal housing and interior partition of the oil filter. Once the tool has penetrated the two sheetmetal surfaces, friction between the tool and the two sheetmetal surfaces holds the tool suspended from the oil filter. With the filter punctured, oil drains through the cavity of the tool to the low end where it is checked by a valve. A suitable container is situated beneath the handle end of the tool, and the valve is opened to allow oil from the oil filter to drain through the tool and into the container. By adjusting the depth of penetration, both chambers of an oil filter can be drained. After the oil has been drained, the tool is extracted.

1 Claim, 3 Drawing Sheets

OIL FILTER HAND PUNCH AND DRAIN TOOL

BACKGROUND OF THE INVENTION

Removal of an oil filter from any vehicle is messy, but in recent years, automobile manufacturers have exacerbated the problem by locating oil filters in poorly accessible locations. The result has been an unnecessarily messy job for the person removing the filter and environmentally undesirable oil spillage onto chassis and suspension components (and consequently, roadways); and the work area.

The Oil Filter Punch is a simple hand tool for draining oil from a vehicular oil filter prior to breaking the seal between the oil filter and its' engine mounting fixture. When the seal between a filter, which is broken, oil streams down the exterior surface of the filter and onto any chassis or suspension components beneath the filter. The object of this device is to direct the discharge of the contents of an oil filter into a suitable collection container, prior to loosening the filter, thereby avoiding oil contact with objects other than the suitable collection container.

SUMMARY OF THE INVENTION

The Oil Filter Punch ruptures a vehicular oil filter and provides a direction to the discharge of its contents. This is accomplished by impaling the filter and allowing the contents to travel through the tool internally. As the location of oil filters on engines varies considerably between engine designs, with varying degrees of accessibility, the Punch and Drain Tube segment of the tool is removable from the Valve and Handle segment to allow the User to select the appropriate length Punch and Drain Tube to reach the filter that is to be punched and drained.

Draining an oil filter with an Oil Filter Punch, prior to the removal of the filter from its mounting fixture, substantially reduces the amount of uncontrolled oil discharge that results when the seal between the oil filter and its' mounting fixture is broken and the filter is removed.

PREFERRED EMBODIMENT

Figure 1:
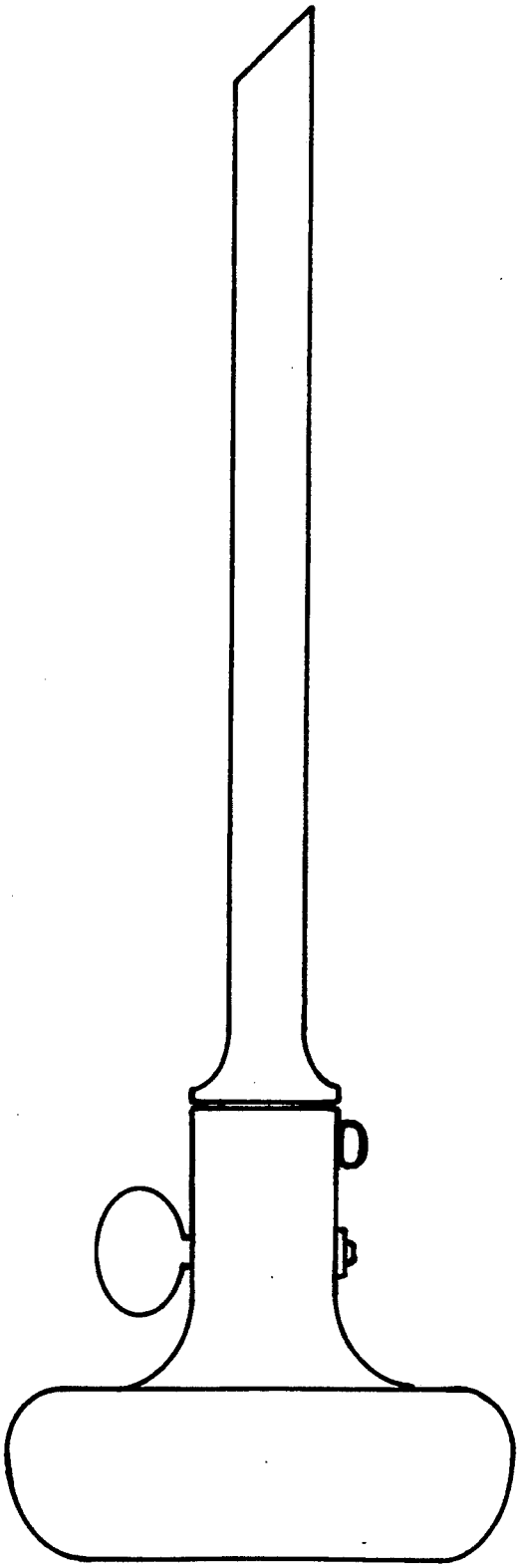
FIG. 1 illustrates an assembled Oil Filter Punch.
Figure 2:
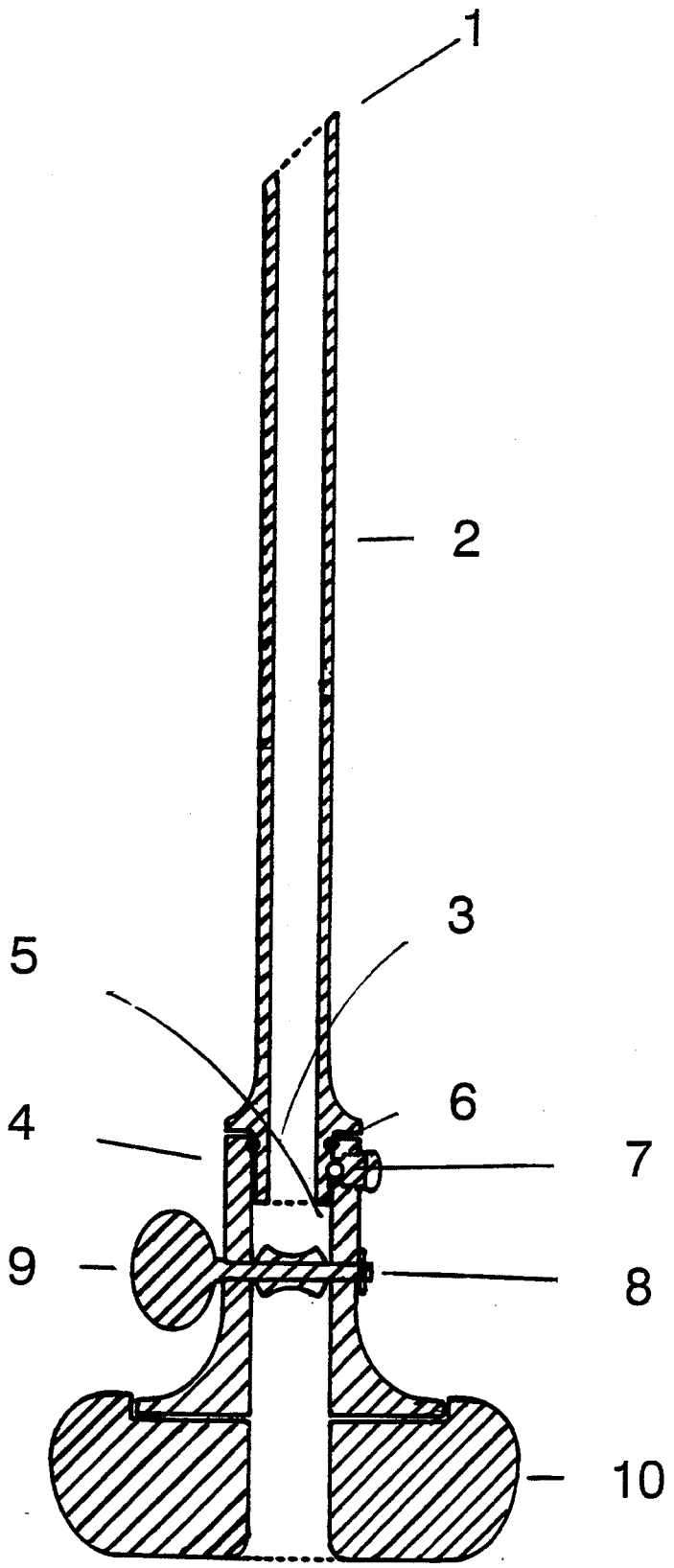
FIG. 2 illustrates an Oil Filter Punch in cross-section, with the valve in the closed position.
Figure 3:
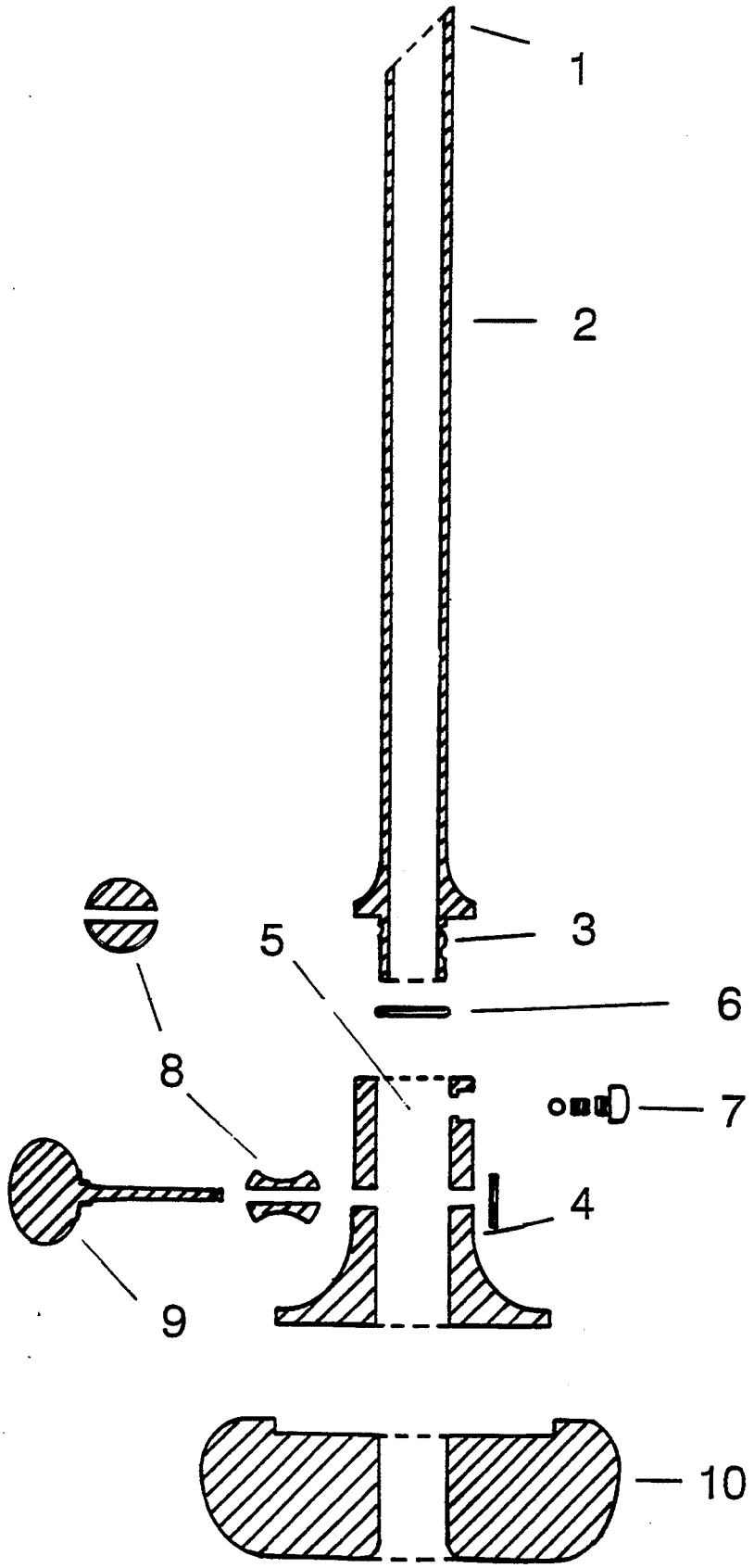
FIG. 3 illustrates an Oil Filter Punch exploded in cross-section, with the valve in the closed position.

An Oil Filter Punch comprises: a Drain Tube (2) in the form of a hollow shaft; a Punch (1) in the form of an angular surface at the filter contact end of the Drain Tube; a male attachment component (3) on the Drain Tube, at the end of the Drain Tube opposite the Punch; a Valve Housing (4) into which the Drain Tube is inserted; a female attachment component (5) on the Valve Housing that mates with the male attachment component of the Drain Tube; a seal (6) on the connection between the Drain Tube and the Valve Housing; a Spring Loaded Ball Bearing Tensioner (7) to secure the Drain Tube to the Valve Housing; a Valve (8) to check the flow from the Drain Tube; an external Hand Manipulatable Valve Actuator (9); and a Handle (10).

I claim:

1. An oil filter puncturing and drainage tool comprising: a hollow shaft, with an angular metal punching means Integral with one end of the hollow shaft and on the opposing end of the hollow shaft, an attachment means; a corresponding attachment means at the end of a handle that removably interconnects with said attachment means at the end of said hollow shaft; said handle having a cavity longitudinally there-through into which the shaft attachment means is inserted into said end to connect with said attachment means of said handle; seal means being provided at the juncture of said shaft and handle attachment means to form a fluid tight juncture there-between; said cavity having a dispensing aperture at the opposite end of said handle; said cavity further Including a valve means that is actuated by hand manipulation to obstruct said cavity to control flow therethrough; said handle being selected from the group of Impact tolerant handle materials; wherein with said valve means not obstructing said cavity,said hollow shaft and said cavity define a flow path from the punching means to said aperture for punching and selectively draining oil from oil filters.

* * * * *